US005518685A

United States Patent [19]

Sakamoto et al.

[11] Patent Number: 5,518,685

[45] Date of Patent: May 21, 1996

[54] STEEL FOR CARBURIZED GEAR

[75] Inventors: Kazuo Sakamoto, Yokohama; Tatsuo Fukuzumi, Tokyo; Hideo Ueno, Muroran, all of Japan

[73] Assignee: Mitsubishi Steel Mfg. Co., Ltd., Tokyo, Japan

[21] Appl. No.: 397,554

[22] Filed: Mar. 2, 1995

Related U.S. Application Data

[63] Continuation-in-part of Ser. No. 289,692, Aug. 12, 1994, abandoned.

[30] Foreign Application Priority Data

Feb. 3, 1994 [JP] Japan ..... 6-030852

[51] Int. Cl.[6] ..... C22C 38/44

[52] U.S. Cl. ..... 420/84; 420/109

[58] Field of Search ..... 148/319; 420/109, 420/84

[56] References Cited

U.S. PATENT DOCUMENTS 4,773,947 9/1988 Shibata et al. ..... 148/319

FOREIGN PATENT DOCUMENTS 57-131350 8/1982 Japan ..... 420/109
57-192248 11/1982 Japan ..... 148/319
62-63653 3/1987 Japan .
63-303035 12/1988 Japan .
3-115542 5/1991 Japan .
4-21757 1/1992 Japan .
4-83848 3/1992 Japan .

*Primary Examiner*—Deborah Yee
*Attorney, Agent, or Firm*—Flynn, Thiel, Boutell & Tanis

[57] ABSTRACT

A steel for darburized gear having softening resistance, consisting essentially of, in weight percentages, 0.18 to 0.25% C, 0.45 to 1.00% Si, 0.40 to 0.70% Mn, 0.30 to 0.70% Ni, 1.00 to 1.50% Cr, 0.30 to 0.70% Mo, up to 0.50% Cu, 0.015 to 0.030% A1, 0.03 to 0.30% V, 0.010 to 0.030% Nb, up to 0.0015% O, 0.0100 to 0.0200% N and the balance consisting of Fe and inevitable impurity elements, wherein quenching at 820° C. or higher after carburization does not cause any ferrite to be formed in a hardened structure of the core part of the carburized steel, and wherein, while tempering is generally performed at 160° to 180° C. after the quenching, reheating at any of temperatures inclusive of the tempering temperature and up to 300° C. does not cause the hardness of a carburized case of the carburized steel to decrease by HV 50 or more from the one after the carburization, quenching and tempering.

2 Claims, 7 Drawing Sheets

[UNIT : mm]

[UNIT : mm]

CARBURIZED AND QUENCHED MICROSTRUCTURE OF CORE PART SHOWING THE EFFECTS OF Si AND Ni CONTENTS ON FERRITE FORMATION. (×400)

CARBURIZED MICROSTRUCTURE OF CORE PART OF INVENTION STEEL (×400)

STEEL FOR CARBURIZED GEAR

This application is a continuation-in-part of U.S. Ser. No. 08/289 692, filed Aug. 12, 1994, now abandoned.

BACKGROUND OF THE INVENTION

1. Field of the Invention

The present invention relates to a steel for carburized gear capable of realizing high fatigue strength and long endurance life by the conventional heat treatment comprising the steps of gas carburization, quenching and tempering. The industrial applications includes the automobile, construction vehicle and industrial machine industries wherein gears are widely used.

2. Description of the Prior Art

For improving the fatigue strength and endurance life of gears treated by gas carburization, quenching and tempering, various techniques have been proposed including the one disclosed in Japanese Patent Application Laid-Open No. 83848/1922. The amounts of Si, M, Cr and the like which are oxidized more easily than Fe are reduced in the steel in order to reduce the interranular oxidation or incompletely hardened layer which cause fatigue cracks, while the hardenability ad mechanical properties thereof are regulated by the incorporation of Ni, Mo or the like which have a resistance to oxidation greater than that of Fe. Such techniques also include one in which a fine spherical carbide is precipitated in the surface part of the steel so as to increase the hardness of the surface by enhancing the carbon potential at the time of carburization. This technique is being generally known as high-concentration carburization, plasma carburization or excess carburization. The various techniques further include one in which a residual surface compression stress is imparted to the steel by shot peening so as to retard the progress of fatigue cracks.

However, all the above techniques for improvements are concerned with the properties of gears prior to actual use, and do not contemplate the gears in actual use, namely in a gearing state under imposed load. Especially, when the driving and driven faces of gears contact each other at a high contact surface pressure, a surface fatigue phenomenon arises which cannot be dealt with only by the contemplation of the properties of the gears prior to use. Additionally, in the recent failures of gears, contact surface fatigue is most predominant in accordance with the demands for higher engine output and promotion of gear miniaturization.

More specifically, in the actual use and gearing state of the gears, it is conceivable that the temperature of the contact surface of the gears is raised to 200°–300° C. by the friction under contact surface pressure inclusive of slip. When exposed to such high temperatures the hardness of the carburized case is decreased as compared with that prior to use.

Maintaining the hardness of the carburized case is the most important factor combatting the surface fatigue. There has been an unsolved problem that, even if the hardness of the carburized case prior to use is improved by the above techniques for improvements, the decrease of the hardness of the carburized case attributed to the frictional heat during use brings about surface fatigue.

In order to solve the above problem easily at a low cost, the present invention has developed a steel for carburized gear capable of providing the gear with softening resistance through the conventional steps of gas carburization, quenching and tempering without resort to any special heat treatment, by regulating the chemical composition of a steel as a material to be carburized. The gist of the present invention resides in utilizing Si which is an element having effective softening resistance. It is believed that Si acts to retard the diffusion of carbon owing to the chemical repulsive force thereof to C to thereby inhibit the formation and cohesion of a carbide which is the cause of the softening of the steel. However, Si is a strong ferrite stabilizing element, so that there is a problem that it elevates the $\gamma \rightarrow \alpha$ a phase transformation initiating temperature of the steel to thereby induce a ferrite formation in a core part structure having a less carbon content at the customary quenching temperature after carburization. The formation of a ferrite is detrimental to strength because it renders the microstructure of the steel nonuniform and thereby preferentially advance cracks. A further problem is that Si is an element in the presence of which an intergranular oxidation is very likely to occur at the time of carburization.

SUMMARY OF THE INVENTION

An object of the present invention is to solve the above problems of the use of Si, and to provide a steel in which the effect of Si contributing to the softening resistance of the steel is markedly exhibited.

The present invention made with a view toward solving the above problems is a steel for carburized gear having softening resistance, consisting essentially of, in weight percentages, 0.18 to 0.25% C, 0.45 to 1.00% Si, 0.40 to 0.70% Mn, 0.30 to 0.70% Ni, 1.00 to 1.50% Cr, 0.30 to 0.70% Mo, up to 0.50% Cu, 0.015 to 0.030% Al, 0.03 to 0.30% V, 0.010 to 0.030% Nb, up to 0.0015% O, 0.0100 to 0.0200% N and the balance consisting of Fe and inevitable impurity elements, wherein quenching at 820° C. or higher after carburization does not cause any ferrite to be formed in a hardened structure of the core part of the steel, and wherein, while tempering is generally performed at 160° to 180° C. after the quenching, reheating at any of temperatures inclusive of the tempering temperature and up to 300° C. does not cause the hardness of a carburized case of the steel to decrease by HV 50 or more from the one after the carburization, quenching and tempering.

Moreover, preferably, there is provided a steel for carburized gear, which further includes at least one member selected from the group consisting of 0.005 to 0.020% S, 0.03 to 0.09% Pb and 0.003 to 0.030% Te, all by weight percentages, as an element capable of improving the machinability of the steel without marked detriment to the fatigue properties thereof.

Throughout the specification, all percentages specified are by weight unless otherwise indicated.

BRIEF DESCRIPTION OF THE DRAWINGS

FIG. 7(*b*) is a schematic diagram of a test piece for use in roller pitting fatigue test;

FIG. 7(*c*) is a schematic diagram of a load roller for use in roller pitting fatigue test;

DETAILED DESCRIPTION OF THE PREFERRED EMBODIMENTS

The starting point of the present invention was to develop a technique for improving the fatigue strength of the carburized gear steel. A first fruit of such development efforts was disclosed in the above Japanese Patent Application Laid-Open No. 83848/1992. However, in recent years, the contact surface pressure applied to gears has increased so much that the occurrence of damages caused by the contact surface fatigue has become frequent. Therefore, besides the above invention, studies have been made to investigate the effects of alloying elements on the resistance to the lowering of the hardness of the carburized case, i.e., the resistance to the softening of the carburized case, against the heat buildup brought about by gear surface contact, with a specified view toward improving the surface fatigue strength of the gear steel.

Figure 1:
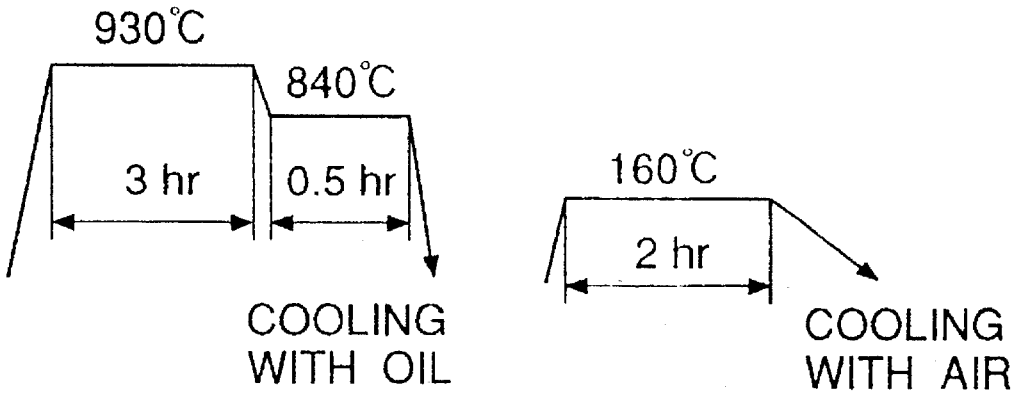
FIG. 1 is an explanatory view of carburizing, quenching and tempering conditions.
Figure 2:
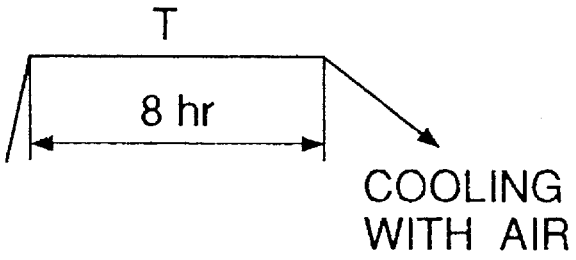
FIG. 2 is an explanatory view of heat treatment conditions adopted in the reheating experiment.
Figure 3:
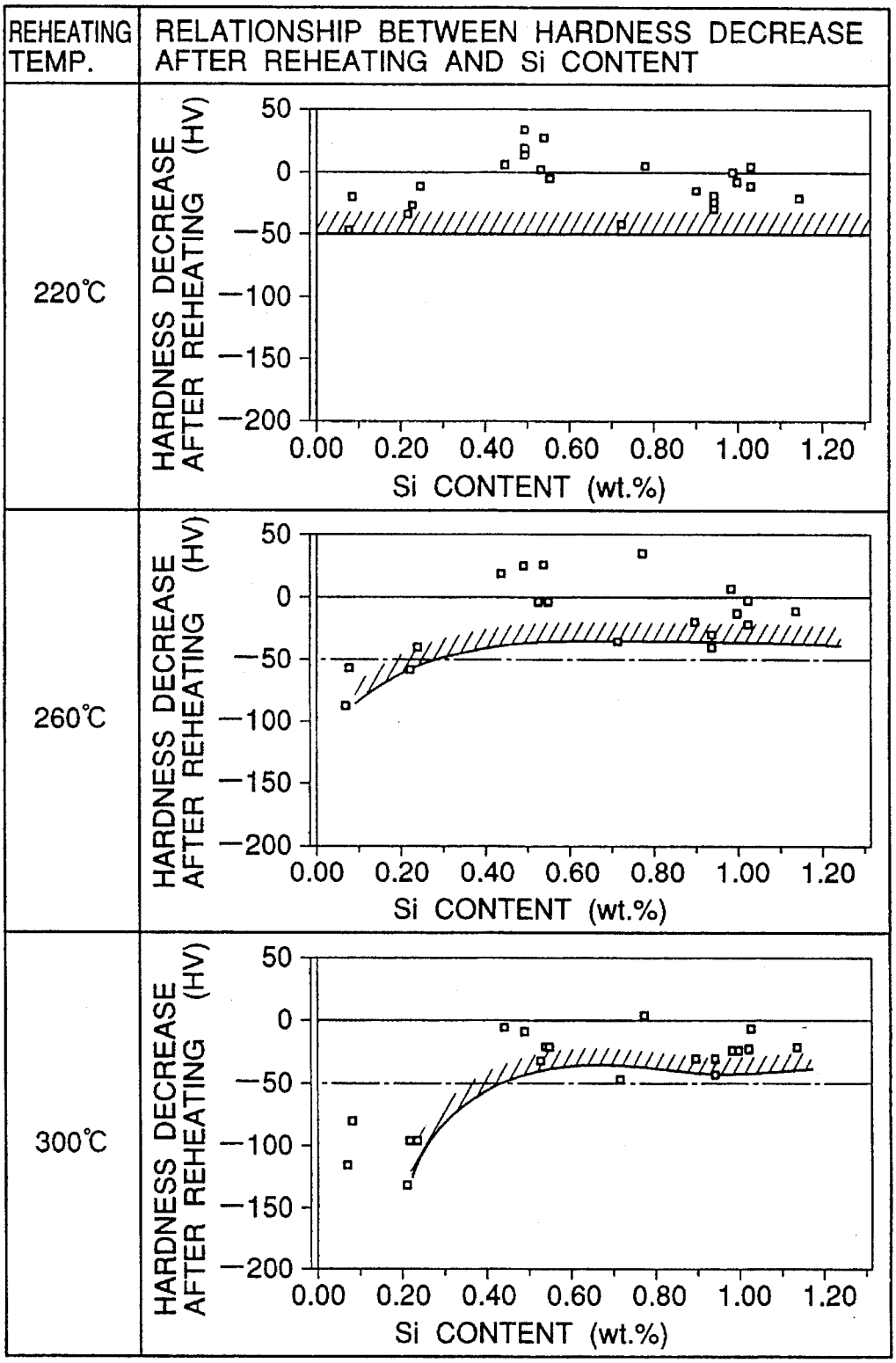
FIG. 3 is a graph showing the relationship between hardness decrease after reheating and Si content.

For preparing test materials, test steel ingots having chemical compositions (by weight %) shown in Tables 1 and 2 were produced by the use of a high-frequency induction melting furnace, hot forged so as to each have a diameter of 30 mm, and normalized at 920° C. for 1 hr. Each of the resulting steels was machined so as to obtain a test piece having a diameter of 25 mm, carburized, quenched and tempered under the conditions as indicated in FIG. 1. With respect to each of the carburized test pieces, a reheating test was conducted under the conditions as indicated in FIG. 2, and the hardness of the carburized case at a depth of 50 μm from the surface of the test piece was measured. Herein, this hardness of the carburized case at a depth of 50 μm from the surface of the test piece is referred to simply as the hardness after the reheating. In Table 3, the difference between the hardness after the reheating at 220° to 300° C. and the hardness at 180° C. as the conventional temperature for tempering subsequent to carburization and quenching, namely the degree of softening, is indicated as the hardness decrease by reheating. The softening resistance was evaluated on the basis of the magnitude of the degree of softening, presuming that the smaller the hardness decrease by reheating, the greater the softening resistance. FIG. 3 shows the relationship between the above hardness decrease by reheating and the Si content of the steel. It is apparent therefrom that, in a region where the Si content is low, the higher the reheating temperature, the greater the hardness decrease. More specifically, when the reheating temperature is 220° C., the hardness decrease is only HV 50 on the maximum, and has scarcely any correlation with the Si content of the steel. When the reheating temperature is 260° C., the hardness decrease exceeds HV 50 in a region where the Si content is 0.25 wt. % or lower. The hardness decrease is more marked when the reheating temperature is 300° C. Provided that any material, the hardness decrease by reheating of which is HV 50 or less, is regarded as having a softening resistance, it has been found that, when the Si content is at least 0.45 wt. %, there is a region where a softening resistance is exhibited even at a reheating temperature as high as 300° C.

In the instant application, both Shibata et al and JP '350 teach away from the claimed Si range of 0.5 to 1.00% weight percent. While Shibata et al claims a range of 1.0 to 3.0% for Si, the desired Si content is higher in order to form an austinite-ferrite two-phase structure. JP '350 describes a range of Si below 0.6%, but the amount of Si in its example range from 0.31% to 0.4% which is at least 0.05% below Applicants' claimed range.

TABLE 1

| No. | C | Si | Mn | P | S | Ni | Cr | Mo | Cu | Al | Nb | Pb | V | Te | [O] | Balance: Fe [N] |
|---|---|---|---|---|---|---|---|---|---|---|---|---|---|---|---|---|
| a | 0.22 | 0.90 | 0.40 | 0.014 | 0.010 | 0.11 | 1.02 | 0.34 | 0.10 | 0.025 | 0.019 | 0.00 | 0.00 | 0.000 | 0.0011 | 0.0125 |
| b | 0.22 | 1.03 | 0.44 | 0.013 | 0.011 | 0.11 | 1.06 | 0.33 | 0.09 | 0.022 | 0.019 | 0.00 | 0.15 | 0.000 | 0.0011 | 0.0120 |
| c | 0.20 | 0.07 | 0.40 | 0.013 | 0.010 | 0.10 | 0.99 | 0.33 | 0.10 | 0.028 | 0.017 | 0.00 | 0.00 | 0.000 | 0.0009 | 0.0125 |
| d | 0.21 | 0.08 | 0.40 | 0.013 | 0.015 | 0.11 | 1.01 | 0.33 | 0.10 | 0.024 | 0.017 | 0.00 | 0.14 | 0.000 | 0.0010 | 0.0150 |
| e | 0.22 | 0.99 | 0.44 | 0.014 | 0.010 | 0.11 | 1.25 | 0.33 | 0.10 | 0.024 | 0.020 | 0.00 | 0.15 | 0.000 | 0.0012 | 0.0107 |
| f | 0.21 | 1.03 | 0.45 | 0.013 | 0.011 | 0.10 | 1.04 | 0.49 | 0.10 | 0.024 | 0.019 | 0.00 | 0.15 | 0.000 | 0.0011 | 0.0125 |
| g | 0.21 | 1.00 | 0.43 | 0.014 | 0.010 | 0.98 | 1.05 | 0.34 | 0.10 | 0.027 | 0.020 | 0.00 | 0.15 | 0.000 | 0.0011 | 0.0128 |
| h | 0.18 | 0.94 | 0.43 | 0.011 | 0.017 | 0.11 | 1.23 | 0.33 | 0.09 | 0.028 | 0.019 | 0.00 | 0.16 | 0.000 | 0.0010 | 0.0185 |
| i | 0.18 | 0.94 | 0.43 | 0.012 | 0.017 | 0.11 | 1.48 | 0.34 | 0.09 | 0.021 | 0.019 | 0.00 | 0.16 | 0.000 | 0.0011 | 0.0125 |
| j | 0.18 | 0.94 | 0.43 | 0.012 | 0.017 | 0.12 | 1.24 | 0.50 | 0.08 | 0.022 | 0.020 | 0.00 | 0.16 | 0.000 | 0.0013 | 0.0125 |
| k | 0.22 | 0.97 | 0.42 | 0.012 | 0.017 | 0.11 | 1.24 | 0.34 | 0.09 | 0.022 | 0.020 | 0.00 | 0.16 | 0.000 | 0.0011 | 0.0112 |
| l | 0.19 | 0.53 | 0.70 | 0.009 | 0.015 | 0.10 | 1.19 | 0.59 | 0.10 | 0.018 | 0.021 | 0.00 | 0.15 | 0.000 | 0.0011 | 0.0113 |

Remark: Nos. a–l: Comparative Steels

TABLE 2

| No. | C | Si | Mn | P | S | Ni | Cr | Mo | Cu | Al | Nb | Pb | V | Te | [O] | Balance: Fe [N] |
|---|---|---|---|---|---|---|---|---|---|---|---|---|---|---|---|---|
| m | 0.18 | 0.55 | 0.44 | 0.010 | 0.020 | 0.50 | 1.50 | 0.70 | 0.10 | 0.015 | 0.030 | 0.03 | 0.30 | 0.003 | 0.0013 | 0.0200 |
| n | 0.20 | 0.49 | 0.65 | 0.010 | 0.011 | 0.50 | 1.22 | 0.60 | 0.10 | 0.018 | 0.024 | 0.00 | 0.15 | 0.000 | 0.0010 | 0.0125 |
| o | 0.20 | 0.55 | 0.67 | 0.011 | 0.016 | 0.50 | 1.24 | 0.58 | 0.09 | 0.029 | 0.022 | 0.05 | 0.16 | 0.000 | 0.0011 | 0.0146 |
| p | 0.21 | 0.45 | 0.64 | 0.010 | 0.011 | 0.50 | 1.45 | 0.60 | 0.10 | 0.022 | 0.022 | 0.00 | 0.15 | 0.025 | 0.0010 | 0.0166 |
| q | 0.20 | 0.72 | 0.66 | 0.010 | 0.017 | 0.70 | 1.23 | 0.60 | 0.10 | 0.020 | 0.021 | 0.00 | 0.17 | 0.000 | 0.0010 | 0.0128 |
| r | 0.20 | 1.00 | 0.70 | 0.010 | 0.017 | 0.50 | 1.26 | 0.60 | 0.11 | 0.018 | 0.022 | 0.00 | 0.16 | 0.000 | 0.0014 | 0.0136 |
| s | 0.20 | 0.54 | 0.65 | 0.010 | 0.016 | 0.30 | 1.20 | 0.60 | 0.10 | 0.023 | 0.021 | 0.00 | 0.16 | 0.000 | 0.0010 | 0.0178 |
| t | 0.20 | 0.78 | 0.65 | 0.009 | 0.015 | 0.50 | 1.25 | 0.59 | 0.10 | 0.019 | 0.022 | 0.00 | 0.15 | 0.000 | 0.0010 | 0.0185 |
| u | 0.25 | 0.52 | 0.40 | 0.010 | 0.005 | 0.70 | 1.00 | 0.30 | 0.50 | 0.030 | 0.010 | 0.09 | 0.30 | 0.030 | 0.0013 | 0.0100 |
| v | 0.25 | 0.53 | 0.42 | 0.010 | 0.005 | 0.70 | 0.99 | 0.30 | 0.10 | 0.020 | 0.010 | 0.00 | 0.10 | 0.000 | 0.0011 | 0.0110 |
| w | 0.25 | 0.52 | 0.39 | 0.010 | 0.005 | 0.70 | 1.00 | 0.30 | 0.10 | 0.025 | 0.010 | 0.00 | 0.03 | 0.000 | 0.0010 | 0.0105 |
| x | 0.21 | 0.22 | 0.88 | 0.017 | 0.013 | 0.08 | 1.18 | 0.03 | 0.10 | 0.019 | 0.020 | 0.00 | 0.00 | 0.000 | 0.0011 | 0.0120 |
| y | 0.22 | 0.24 | 0.90 | 0.014 | 0.015 | 0.09 | 1.19 | 0.21 | 0.12 | 0.023 | 0.018 | 0.00 | 0.00 | 0.000 | 0.0007 | 0.0123 |
| z | 0.22 | 0.21 | 0.64 | 0.014 | 0.012 | 1.66 | 0.61 | 0.20 | 0.15 | 0.021 | 0.024 | 0.00 | 0.00 | 0.000 | 0.0008 | 0.0120 |

Remark:
Nos. m–w: Invention Steels
Nos. x–z: Current Steels

Figure 4:
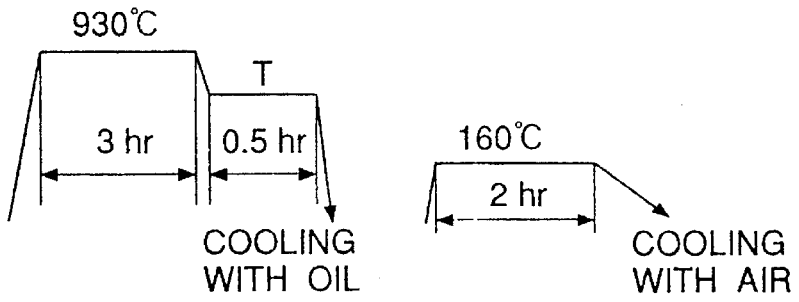
FIG. 4 is an explanatory view of heat treatment conditions adopted in the experiment simulating the carburization and quenching at the core part of each of the test materials of Table 1 and 2.
Figure 10:
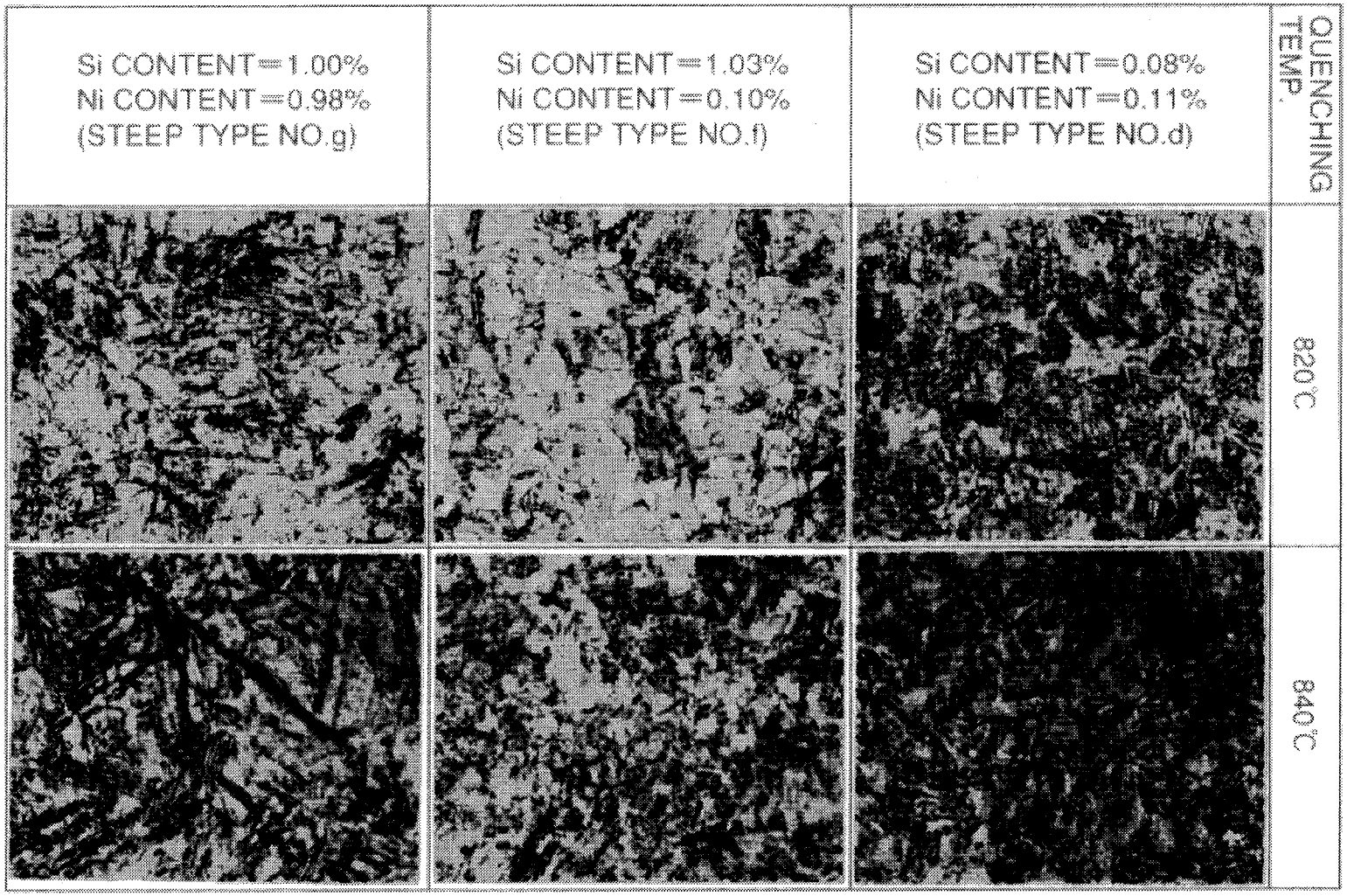
FIG. 10 is micrographs showing the microstructures of metal test pieces carburized under the conditions shown in FIG. 4.

On the other hand, as mentioned hereinbefore, there is problems that the addition of Si elevates the $\gamma \rightarrow \alpha$ a phase transformation initiating temperature of the steel, and that a ferrite phase is generated at the time of quenching subsequent to carburization. As means for coping with these problems, the positive effect of the addition of an austenire stabilizing element on the lowering of the phase transformation initiating temperature of the steel was utilized in the present invention. In particular it has been noted that Ni as an alloying element not only inhibits ferrite formation but also improves toughness of gear steel, and thus the application of Ni has been attempted. First, the above test pieces prepared from the test materials indicated in Tables 1 and 2 were carburized, quenched and tempered under the conditions indicated in FIG. 4. The microstructure, after quenching, at a depth of 3 mm from the surface thereof was observed under an optical microscope to examine the formation of any ferrite. At the examined depth, the carbon concentration was satisfactorily low. An exemplary result obtained by the microscopic observation is shown in FIG. 10. It is apparent therefrom that when the Ni content is as low as about 0.10 wt. %, an increase of the Si content to about 1.00 wt. % causes ferrite formation in the carburized microstructure (compare steel type No. d with steel type No. f). The degree of the formation is more marked at a lower quenching temperature of 820° C. On the other hand, even if the Si content is as high as about 1.00 wt. %, it is apparent that ferrite formation does not occur when the Ni content is increased to about 1.00 wt. % (compare steel type No. f with steel type No. g).

Figure 5:
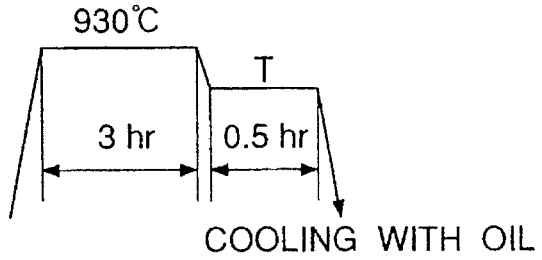
FIG. 5 is an explanatory view of the conditions for carburization and quenching of a test piece.

Next, for confirming the effect of Ni on the inhibition of ferrite formation in greater detail, experiments were conducted in which the contents of Si and Ni were varied. While the chemical components of the test materials and the procedure of machining the test pieces were as described above, the heat treatment of the test pieces was carried out under the conditions as shown in FIG. 5. With respect to each of the test pieces after the heat treatment, the microstructure thereof was observed under an optical microscope to examine the formation of any ferrite. The results are shown in Table 3. Therein, the mark "o" indicates that no ferrite formation was observed, the mark "Δ" that the formation of a small amount of ferrite was observed, and mark "x" that the formation of a large amount of ferrite was observed. The table shows that each of the steels in which only the Si content has been increased without regulating the Ni content, such as comparative steels a and b, e and f and h to 1, exhibits a hardness decrease after reheating up to 300° C. of not greater than HV 50, thus having a softening resistance, but suffers from ferrite formation at quenching at 820° to 840° C. By contrast, it has been found that each of comparative steel g and steels of the present invention m to w in which the Si content has been increased while regulating the Ni content not only has a softening resistance but also suffers from no ferrite formation at any of the quenching temperatures. Further, the Table shows that comparative steels c and d and currently used steels x to z each having a low Si content do not suffer from ferrite formation at any of the quenching temperatures, though each exhibits a hardness decrease after reheating at 300° C. of greater than HV 50, thus having no softening resistance. From the above results, it has been found that there is a compositional range in which improvement of the softening resistance by Si without the formation of any ferrite even at a quenching temperature of 820° C. or higher can be attained by regulating the Ni content of the steel.

TABLE 3

| | Hardness decrease after reheating (HV) | | | Observation of ferrite formation at each hardening temp. | | | |
|---|---|---|---|---|---|---|---|
| No. | 220° C. | 260° C. | 300° C. | 820° C. | 840° C. | 860° C. | 880° C. |
| a | −16 | −19 | −32 | x | x | x | x |
| b | −13 | −23 | −27 | x | x | x | x |
| c | −45 | −85 | −113 | o | o | o | o |
| d | −17 | −56 | −77 | o | o | o | o |
| e | −1 | −2 | −29 | x | x | x | x |
| f | 2 | −6 | −9 | x | x | x | x |
| g | −10 | −15 | −28 | o | o | o | o |
| h | −20 | −40 | −41 | x | x | x | x |
| i | −32 | −30 | −34 | x | x | x | x |
| j | −23 | −30 | −33 | x | x | x | Δ |
| k | −22 | −36 | −40 | x | x | x | Δ |
| l | 2 | −5 | −32 | x | Δ | o | o |
| m | −25 | −15 | −10 | o | o | o | o |
| n | 33 | 21 | −10 | o | o | o | o |
| o | −5 | −5 | −22 | o | o | o | o |
| p | 7 | 16 | −7 | o | o | o | o |
| q | −43 | −37 | −45 | o | o | o | o |
| r | −23 | −13 | −25 | o | o | o | o |
| s | 27 | 22 | −21 | o | o | o | o |
| t | 6 | 31 | 5 | o | o | o | o |
| u | 15 | −5 | −25 | o | o | o | o |
| v | 13 | −7 | −28 | o | o | o | o |
| w | 12 | −10 | −32 | o | o | Δ | o |

TABLE 3-continued

| No. | Hardness decrease after reheating (HV) 220° C. | 260° C. | 300° C. | Observation of ferrite formation at each hardening temp. 820° C. | 840° C. | 860° C. | 880° C. |
|---|---|---|---|---|---|---|---|
| x | −24 | −57 | −94 | o | o | o | o |
| y | −9 | −40 | −94 | o | o | o | o |
| z | −34 | −55 | −132 | o | o | o | o |

o: no ferrite formation observed.
Δ: ferrite formation slightly observed.
x: marked ferrite formation observed.
Nos. m–l: Comparative Steels
Nos. m–w: Invention Steels
Nos. x–z: Current Steels Finally, the occurrence of intergranular oxidation by the addition of Si has been studied. Although Si is believed to promote intergranular oxidation as mentioned hereinbefore, the behavior thereof has been investigated in the ranges broader than the conventional. As a result, a compositional range has been found in which the intergranular oxidation can be suppressed. Table 4 shows the chemical composition (by weight %) of the test pieces having been investigated. The procedure of machining the test pieces was as described above, and the prepared test pieces were carburized and quenched under the conditions indicated in FIG. 1. With respect to each of the carburized test pieces, the structure of the carburized surface thereof was observed under an optical microscope to thereby measure the intergranular oxidation depth.

TABLE 4

| No. | C | Si | Mn | P | S | Ni | Cr | Mo | Cu | Al | Nb | V | Balance: Fe [O] | [N] |
|---|---|---|---|---|---|---|---|---|---|---|---|---|---|---|
| A | 0.19 | 0.02 | 0.51 | 0.014 | 0.017 | 0.56 | 0.49 | 0.73 | 0.15 | 0.025 | 0.017 | 0.15 | 0.0010 | 0.0120 |
| B | 0.20 | 0.07 | 0.53 | 0.014 | 0.002 | 0.65 | 0.49 | 0.69 | 0.14 | 0.023 | 0.015 | 0.15 | 0.0011 | 0.0114 |
| C | 0.20 | 0.18 | 0.55 | 0.014 | 0.018 | 0.60 | 0.50 | 0.69 | 0.14 | 0.025 | 0.020 | 0.16 | 0.0010 | 0.0151 |
| D | 0.19 | 0.25 | 0.57 | 0.014 | 0.017 | 0.59 | 0.47 | 0.68 | 0.14 | 0.023 | 0.019 | 0.15 | 0.0009 | 0.0161 |
| E | 0.20 | 0.48 | 0.58 | 0.014 | 0.017 | 0.58 | 0.48 | 0.70 | 0.15 | 0.020 | 0.020 | 0.16 | 0.0008 | 0.0143 |
| F | 0.20 | 1.03 | 0.60 | 0.015 | 0.018 | 0.63 | 0.52 | 0.69 | 0.15 | 0.025 | 0.020 | 0.15 | 0.0011 | 0.0164 |
| G | 0.21 | 1.61 | 0.60 | 0.016 | 0.018 | 0.58 | 0.51 | 0.70 | 0.14 | 0.025 | 0.020 | 0.15 | 0.0012 | 0.0153 |
| H | 0.21 | 2.14 | 0.60 | 0.014 | 0.019 | 0.60 | 0.48 | 0.70 | 0.14 | 0.023 | 0.021 | 0.17 | 0.0010 | 0.0110 |

Figure 6:
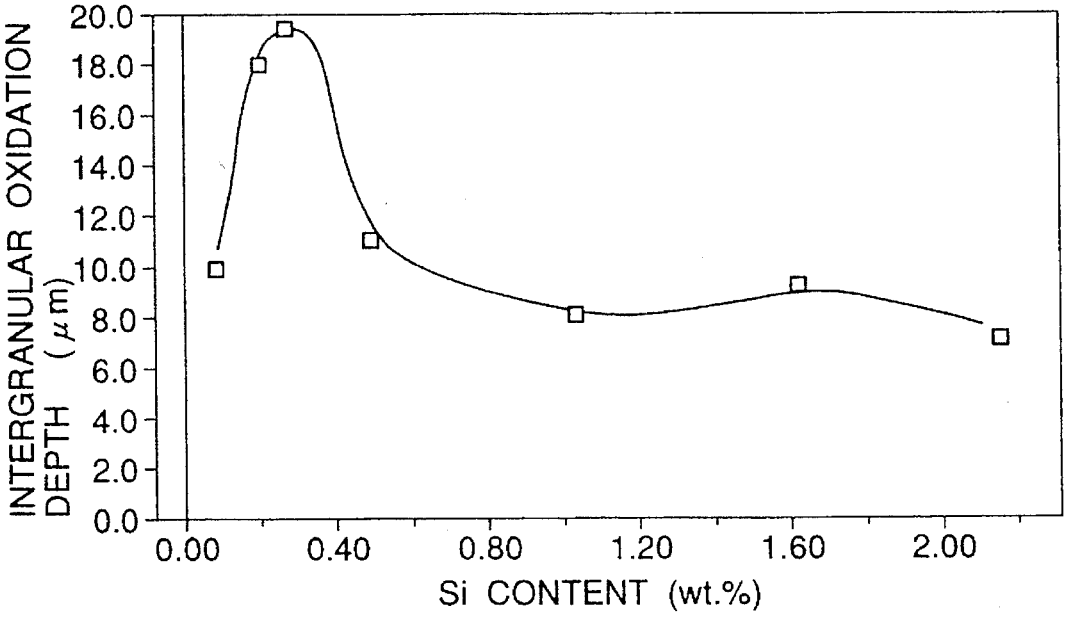
FIG. 6 is a graph showing the relation ship between intergranular oxidation depth and Si content.

FIG. 6 shows the relationship between the above intergranular oxidation depth and the Si content of the steel. Therefrom, it is apparent that, as pointed out in the art, the intergranular oxidation depth proportionally increases up to an Si content of 0.25 wt. %, and that, however, the depth contrarily decreases when the Si content exceeds the above value and is limited to approximately 10 μm when the Si content is 0.45 wt. % or greater. Accordingly, it has been found that, in a region where the Si content is 0.45 wt. % or greater to thereby have a softening resistance, the intergranular oxidation depth does not pose any problem.

On the basis of the above fundamental studies, particular means has been found for improving the softening resistance to thereby improve the fatigue resistance or endurance life while solving the problems of ferrite formation and increased occurrence of intergranular oxidation attributed to Si.

Therefore, the present invention provides a steel for carburized gear having softening resistance, consisting essentially of, in weight percentages, 0.18 to 0.25% C, 0.45 to 1.00% Si, 0.40 to 0.70% Mn, 0.30 to 0.70% Ni, 1.00 to 1.50% Cr, 0.30 to 0.70% Mo, up to 0.50 Cu, 0.015 to 0.030% Al, 0.03 to 0.30% V, 0.010 to 0.030% Nb, up to 0.0015% O, 0.0100 to 0.0200% N and the balance consisting of Fe and inevitable impurity elements, wherein quenching at 820° C. or higher after carburization does not cause any ferrite to be formed in a hardened structure of the core part of the carburized steel, and wherein, while tempering is generally performed at 160° to 180° C. after the quenching, reheating at any of temperatures inclusive of the tempering temperature and up to 300° C. does not cause the hardness of a carburized case of the carburized steel to decrease by HV 50 or more from the one after the carburization, quenching and tempering. Moreover, according to necessity, the carburized steel for gear is characterized by further including, in its material, at least one member selected from among 0.005 to 0.020 wt. % S, 0.03 to 0.09 wt. % Pb and 0.003 to 0.030 wt. % Te, as an element capable of improving the machinability of the steel.

With respect to the above composition according to the present invention, the reasons for the numerical limitations will be described below.

C: 0.18 to 0.25%

The addition of C in an amount of at least 0.18% is required for obtaining a core part hardness of HRC 35 to 45 to be possessed by gears. When the amount of C is too small, the $\gamma \rightarrow \alpha$ phase transformation initiating temperature is excessively high, so that the control thereof by the addition of an austenite stabilizing element becomes difficult. On the other hand, the addition of excess C causes the hardness of the core part to increase so excessively that not only is satisfactory introduction of a residual surface compression stress unfeasible after quenching but also the toughness of the core part is deteriorated. For avoiding this, the upper limit must be restricted to 0.25%.

Therefore, the amount of C to be added ranges from 0.18% to 0.25%.

Si: 0.45 to 1.00%

Si is the most important of the elements to be incorporated in the steel of the present invention. That is, Si is an element capable of most effectively increasing the softening resistance at a temperature ranging from 200° to 300° C. which is believed to be reached during the rolling of gears, etc. For effectively exhibiting the above capability, it is requisite that at least 0.45% Si be added. However, since Si is a ferrite stabilizing element as generally recognized, the addition of excess Si raises the Ac3 transforming point, so that the ferrite formation at the core part at which the carbon content is low becomes marked in the conventional quenching at temperatures ranging from 820° to 860° C., thereby inviting a strength deterioration. Further, the excess Si would diminish the carburizability of the steel and cause the steel prior to carburization to become too hard, thereby deteriorating the cold forgeability and machinability of the steel. For avoiding these, the upper limit must be restricted to 1.00%.

Therefore, the amount of Si to be added ranges from 0.45% to 1.00%.

Mn: 0.40 to 0.70%

Mn must be added in an amount of at least 0.40% in order to ensure the hardenability of the steel. However, Mn is likely to cause an intergranular oxidation. For reducing this likelihood, the upper limit of the amount of Mn must be restricted to 0.70%.

Therefore, the amount of Mn to be added ranges from 0.40% to 0.70%.

Ni: 0.30 to 0.70%

In the steel of the present invention, Ni is an element as important as Si. That is, since Ni is an austenite stabilizing element in contrast with Si, Ni lowers the $\gamma \rightarrow \alpha$ phase transformation initiating temperature elevated by the addition of Si. Further, simultaneously, Ni is an element which improves not only the hardenability of the steel but also the toughnesses of the carburized case and the core part. For exercising these effects, Ni must be added in an amount of at least 0.30%. However, since Ni is an expensive element, the addition of excess Ni is not desirable from the economic point of view. Moreover, it rather intensifies the formation of residual austenite to thereby invite lowering of the hardness of the surface of the steel. For avoiding these, the upper limit of the amount of Ni must be restricted to 0.70%.

Therefore, the amount of Ni to be added ranges from 0.30% to 0.70%.

Cr: 1.00 to 1.50%

Cr is an element required for ensuring the hardenability of the steel. Also, it is an element from which precipitation of a fine carbide can be expected. For attaining these desired effects, Cr must be added in an amount of at least 1.00%. However Cr is an element which is likely to cause an intergranular oxidation, like Mn, so that the addition of excess Cr renders the core part too hard, thereby deteriorating the toughness thereof. For avoiding this, the upper limit of the amount of Cr must be restricted to 1.50%.

Therefore, the amount of Cr to be added ranges from 1.00% to 1.50%.

Mo: 0.30 to 0.70%

Mo is an element which improves not only the hardenability of the steel but also the toughnesses of the carburized case and the core part like Ni. For exercising these effects, Mo must be added in an amount of at least 0.30%. However, the addition of excess Mo not only renders the softening treatment of the steel prior to carburization difficult to thereby deteriorate the machinability of the steel, but also renders the core part so excessively hard as to deteriorate the toughness thereof. For avoiding these, the upper limit of the amount of Mo must be restricted to 0.70%.

Therefore, the amount of Mo to be added ranges from 0.30% to 0.70%.

Cu: up to 0.50%

Cu is an element from which precipitation hardening can be expected at a relatively high temperature ranging from 400° to 600° C. Therefore, Cu is preferably added to the steel for use under severe conditions, such as gear tooth and rolling contact surfaces where an extreme temperature elevation is caused, is presumed, or when it is used in a high temperature environment, e.g., in aircraft materials disposed in the vicinity of jet propulsion machinery or a turbine. However, the addition of excess Cu intensifies the hot brittleness of the steel and deteriorates the carburizability of the steel. For avoiding these, the upper limit of the amount of Cu must be restricted to 0.50%.

Therefore, the amount of Cu to be added is limited to 0.50% or less.

Al: 0.015 to 0.030%

Al is an element which is bonded to N to from AlN, thereby acting to refine the grain size of austenire crystal. Through the refining activity, it contributes to improvement of the toughnesses of the carburized case and the core part. For this purpose, it is necessary to add Al in an amount of at least 0.015%. However, the addition of excess Al increases the formation of $Al_{2O3}$ as an inclusion hazardous for the fatigue strength of the steel. For avoiding this, the upper limit of the amount of Al must be restricted to 0.030%. Therefore, the amount of Al to be added ranges from 0.015% to 0.030%.

V: 0.03 to 0.30%

Even at relatively low temperatures close to the carburizing temperature, V forms a carbide, from which a hardness improvement can be expected. For attaining the hardness improvement, it is necessary to add V in an amount of at least 0.03%. However, the addition of excess V deteriorates the toughness of the carburized case of the steel. For avoiding this, the upper limit of the amount of V musk be restricted to 0.30%.

Therefore, the amount of V to be added ranges from 0.03% to 0.30%.

Nb: 0.010 to 0.030%

Nb is an element which is bonded to the C and N in the steel to form a carbonitride, thereby acting to refine the grain size of austenire crystal, like AlN. Through the refining activity, it contributes to improvement of the toughnesses of the carburized case and the core part. Accordingly, the amount of Nb to be added is determined depending on the quantitative balance between coexistent Al and N. When the amount is too small, no desired effect can be exercised. Thus, it is requisite that Nb be added in an amount of at least 0.010%. However, the addition of excess Nb causes grain coarsening of carbonitride precipitated, thereby deteriorating the toughness of the carburized case of the steel. For avoiding this, the upper limit of the amount of Nb musk be restricted to 0.030%.

Therefore, the amount of Nb to be added ranges from 0.010% to 0.030%.

O: up to 0.0015%

O is an element which is present in the steel as an oxide inclusion, causing the fatigue strength of the steel to be deteriorated.

Therefore, the upper limit of the amount of O is set at 0.0015%.

N: 0.0100 to 0.0200%

N is an element which is bonded to Al and Nb to form AlN and NbCN, thereby acting to refine the grain size of austenire crystal. Through the refining activity, it contributes to improvement of the toughnesses of the carburized case and the core part. Accordingly, the amount of N to be added is determined depending on the quantitative balance between coexistent Al and Nb. When the amount is too small, no desired effect can be exercised. Thus, it is requisite that N be added in an amount of an least 0.0100%. However, the addition of excess N invites not only the occurrence of pores in the surface part of a steel ingot at the time of solidification but also deterioration of the forgeability of the steel. For avoiding these, the upper limit of the amount of N must be restricted to 0.0200%.

Therefore, the amount of N to be added ranges from 0.0100% to 0.0200%.

S: 0.005 to 0.020%

S is an element which is mostly present in the form of a sulfide inclusion in the steel, thus being effective in the improvement of machinability of the steel. The machinability is important for gears and other parts shaped by cutting work. For ensuring the above effect, it is necessary to add S in an amount of at least 0.005%. However, the addition of excess S invites deterioration of the fatigue strength of the steel. For avoiding these, the upper limit of the amount of S must be restricted to 0.020%.

Therefore, the amount of S to be added ranges from 0.005% to 0.020%.

Pb: 0.03 to 0.09%

Pb is an element which is effective in the improvement of machinability of the steel, the machinability being important for gears and other parts shaped by cutting work. For ensuring the above effect, it is necessary to add Pb in an amount of at least 0.03%. However, the addition of excess Pb invites deterioration of the fatigue strength of the steel. Further, when the amount is 0.10% or more, the use of Pb falls under legal regulations regarding air pollution. For avoiding these, the upper limit of the amount of Pb must be restricted to 0.09%.

Therefore, the amount of Pb to be added ranges from 0.03% to 0.09%.

Te: 0.003 to 0.030%

Te is an element which improves the machinability of the steel. For attaining this effect, it is necessary to add Te in an amount of at least 0.003%. However, the addition of excess Te causes the steel to have a hot brittleness. For avoiding this, the upper limit of the amount of Te must be restricted to 0.030%.

Therefore, the amount of Te to be added ranges from 0.003% to 0.030%.

The present invention will now be described in greater detail with reference to the following Example.

EXAMPLE

In order to confirm that the improvement of the pitting fatigue strength, which is the primary object of the present invention, can be attained on the basis of the above results, a test steel ingot comprising the chemical composition (by weight %) shown in Table 5 was produced according to the present invention by the use of a high-frequency induction vacuum melting furnace, and the pitting fatigue life thereof was evaluated by the roller pitting fatigue test.

TABLE 5

| C | Si | Mn | P | S | Ni | Cr | Balance: Fe Mo |
|---|---|---|---|---|---|---|---|
| 0.22 | 0.77 | 0.42 | 0.012 | 0.012 | 0.50 | 1.24 | 0.34 |
| Cu | Al | Nb | Pb | V | Te | [O] | [N] |
| 0.09 | 0.027 | 0.020 | 0.00 | 0.16 | 0.000 | 0.0009 | 0.0154 |

Figure 7A:
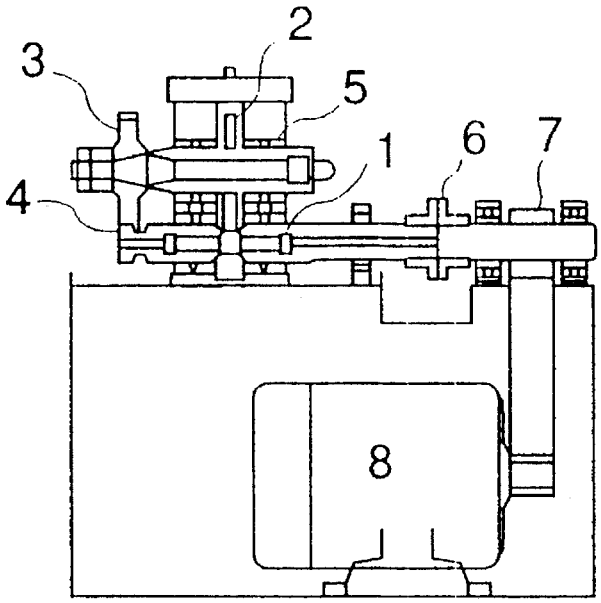
FIG. 7(*a*) is a schematic diagram of a roller pitting fatigue tester.
Figure 7B:
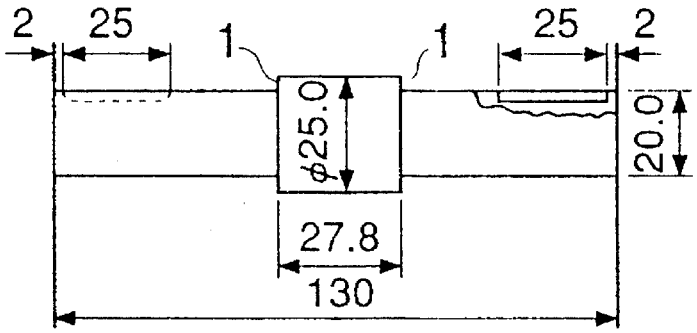
Figure 7C:
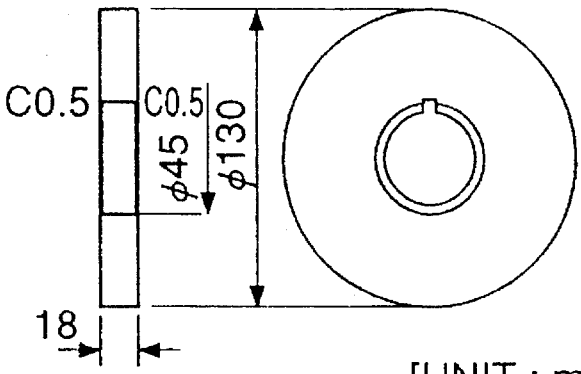
Figure 11:
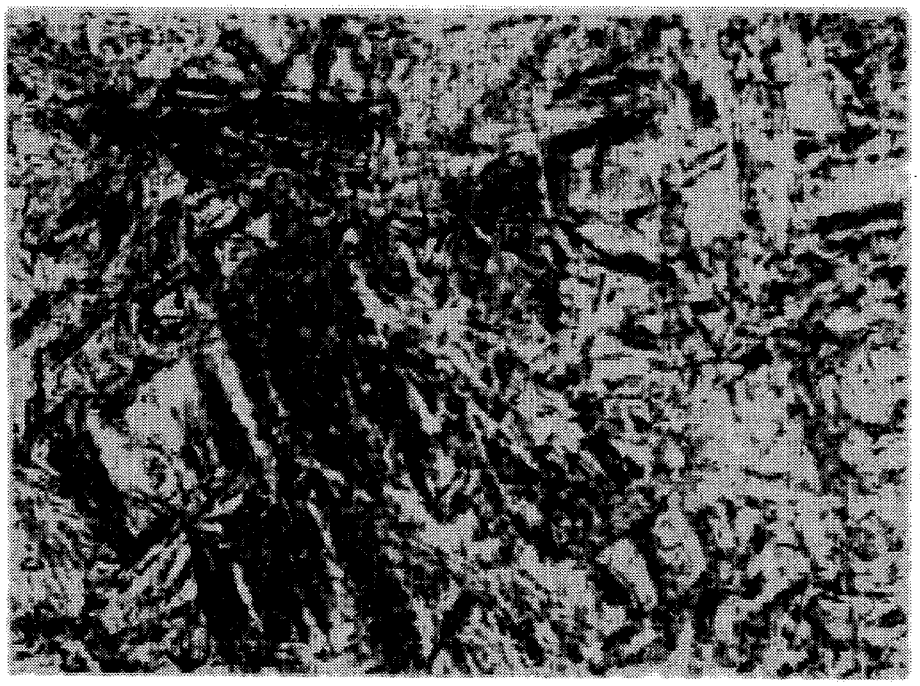
FIG. 11 is a micrograph showing the carburized microstructure of a core part of a conventional steel processed under the conditions shown in FIG. 1.

FIG. 7 (*a*) shows an outline of a roller pitting fatigue tester. Therein, numeral 1 denotes a test piece, numeral 2 a load roller, numerals 3, 4 gearing gears, numeral 5 a bearing, numeral 6 a coupling, numeral 7 a transmission belt, and numeral 8 a motor. FIG. 7(*b*) shows the configuration of a test piece. FIG. 7(*c*) shows the configuration of a load roller. The dimensions indicated in FIGS. 7(*b*) and (*c*) are all in millimeters. The test was conducted under conditions such that the maximum Hertz's contact surface pressure was 3430 MPa, and that the slip ratio was 40%. The test steel ingot was hot-forged, normalized and machined into a test piece. The test piece was carburized, quenched and tempered under the conditions indicated in FIG. 1. A part was cut off the test piece, and, with respect to the part, the hardness distribution of the carburized case was determined and the microstructure thereof was observed. The results are shown in FIG. 11 and Table 6.

TABLE 6

| | Carburization Characteristics | | |
|---|---|---|---|
| Surface hardness | Effective hardened case depth | Hardness of core part | Depth of intergranular oxide layer |
| HV 756 | 0.90 mm | HV 468 | 8.5 μm |

Figure 8:
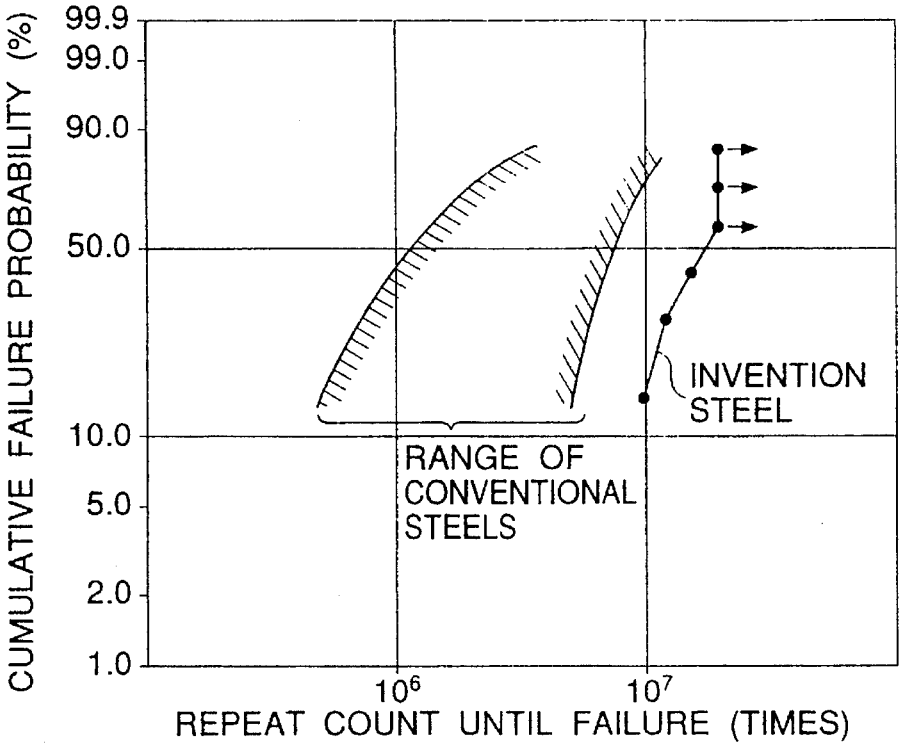
FIG. 8 is a graph showing the pitting fatigue lives of the steel of the present invention and conventional steels.
Figure 9:
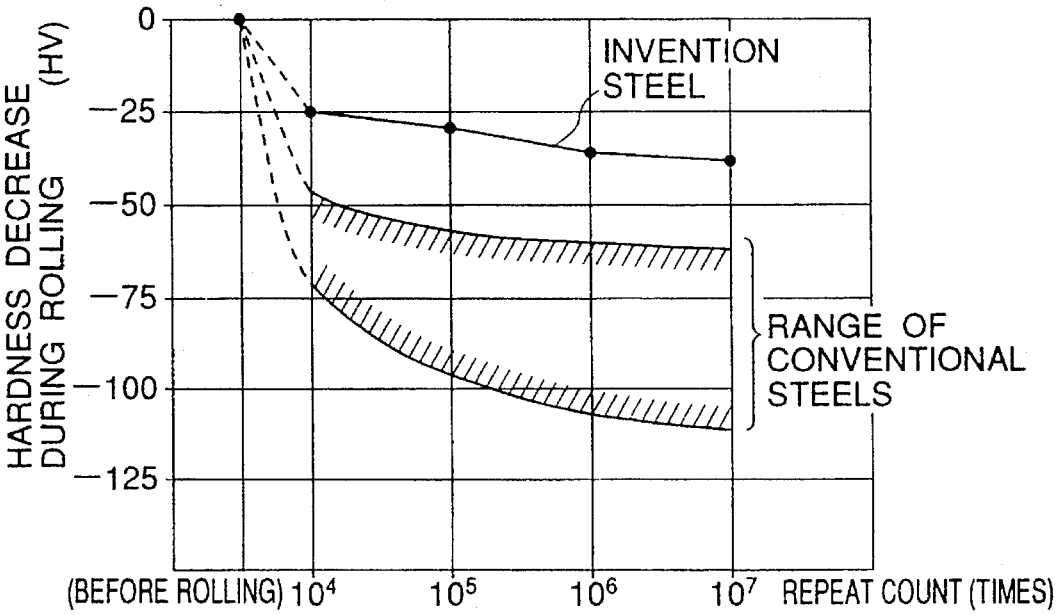
FIG. 9 shows the changes of surface hardness decrease during rolling with time of the steel of the present invention and conventional steels.

As a result, first, it has been confirmed that, in the steel of the present invention, there is no ferrite formation in its core part, and that the depth of intergranular oxidation therein is as small as 8.5 μm. FIG. 8 shows the results of the roller pitting fatigue test. Therein, the pitting fatigue life of the steel of the present invention, together with those of the conventional steels, is shown in terms of cumulative fracture probability. It is apparent from the results thereof that the pitting fatigue life of the steel of the present invention is prolonged beyond the range of those of the conventional steels. FIG. 9 shows the results obtained by interrupting the fatigue test at each given repeat count and measuring the surface hardness for grasping the decrease with time of the hardness during rolling in the fatigue test. The results of the steel of the present invention are shown together with those of the conventional steels. It is apparent therefrom that the surface hardness decrease during rolling of the steel of the present invention is less than the range of those of the conventional steels. Therefore, in accordance with the alloying design concept, it can be interpreted that, as the effects of the increase in Si content, the softening resistance is improved; the surface hardness decrease under the influence of frictional heat during rolling at a high contact surface pressure including slip, which surface hardness is the most important factor for the pitting fatigue strength, is suppressed; there is no ferrite formation at the core part; and the intergranular oxidation depth is small, so that the fatigue life is prolonged. As apparent from the above, the steel of the present invention exhibits a prolonged pitting fatigue life and has advantageous properties as compared with those of the current steels.

As demonstrated by the above results, the steel of the present invention is strikingly excellent in the pitting fatigue strength now being the most important requirement for gears as compared with the conventional steel. Therefore, the employment of the steel of the present invention makes it possible not only to effect miniaturization and weight reduction of the steel gear while utilizing the conventional carburization and quenching conditions and design items as they are, but also to realize higher output even with the same configuration and size.

Therefore, the effects of the present invention permit wide contributions to cost reduction and reliability improvement in industries where gears are utilized under severe conditions.

What is claimed is:

1. A steel for carburized gear having softening resistance, consisting essentially of, in weight percentages, 0.18 to 0.25% C, 0.45 to 1.00% Si, 0.40 to 0.70% Mn, 0.30 to 0.70% Ni, 1.00 to 1.50% Cr, 0.30 to 0.70% Mo, up to 0.50% Cu, 0.015 to 0.030% Al, 0.03 to 0.30% V, 0.010 to 0.030% Nb, up to 0.0015% O, 0.00100 to 0.0200% N and the balance consisting of Fe and inevitable impurity elements, wherein quenching at 820° C. or higher after carburization does not cause any ferrite to be formed in a hardened structure of the core part of the carburized steel, and wherein, while tempering is generally performed at 160° to 180° C. after the quenching, reheating at any of temperatures inclusive of said tempering temperature and up to 300° C. does not cause the hardness of a carburized case of the carburized steel to decrease by HV 50 or more from the one after said carburization, quenching and tempering.

2. The steel for carburized gear according to claim 1, which further includes, in its material, at least one member selected from the group consisting of 0.005 to 0.020% S, 0.03 to 0.09% Pb and 0.003 to 0.030% Te, all in weight percentages, as an element capable of improving the machinability of the steel without marked detriment to the fatigue properties thereof.

* * * * *